US007699185B2

(12) United States Patent
Heien

(10) Patent No.: US 7,699,185 B2
(45) Date of Patent: Apr. 20, 2010

(54) MULTI-COMPARTMENT TRASH OR RECYCLING BAG

(76) Inventor: Troy A. Heien, 5704 S. View Rd., Laramie, WY (US) 62070

( * ) Notice: Subject to any disclaimer, the term of this patent is extended or adjusted under 35 U.S.C. 154(b) by 998 days.

(21) Appl. No.: 11/370,712

(22) Filed: Mar. 8, 2006

(65) Prior Publication Data

US 2007/0211966 A1 Sep. 13, 2007

(51) Int. Cl.

| | |
|---|---|
| ***B65D 25/14*** | (2006.01) |
| ***B65D 30/00*** | (2006.01) |
| ***B65D 30/22*** | (2006.01) |
| ***B65D 33/28*** | (2006.01) |
| ***B65D 33/30*** | (2006.01) |

(52) U.S. Cl. ..... 220/495.11; 220/495.07; 383/37; 383/38; 383/75; 383/88

(58) Field of Classification Search ..... 383/37, 383/38, 39, 40, 9, 111, 87, 75, 88; 220/495.07, 220/495.09, 459.11

See application file for complete search history.

(56) References Cited

U.S. PATENT DOCUMENTS

| | | | | |
|---|---|---|---|---|
| 3,160,273 | A * | 12/1964 | Reuther et al. | 206/390 |
| 4,750,639 | A * | 6/1988 | Schaerer | 383/37 |
| 4,759,467 | A * | 7/1988 | Byrne | 220/495.08 |
| 4,802,582 | A * | 2/1989 | Johnson | 206/390 |
| 4,978,018 | A * | 12/1990 | Wood | 220/531 |
| 4,993,844 | A * | 2/1991 | Robinson et al. | 383/38 |
| 5,190,252 | A * | 3/1993 | Schrager | 248/97 |
| 5,228,574 | A * | 7/1993 | Rogers | 383/38 |
| 5,598,919 | A * | 2/1997 | Taylor | 383/37 |
| 5,964,252 | A * | 10/1999 | Simmons et al. | 138/149 |
| 6,036,363 | A * | 3/2000 | Behnk | 383/38 |
| 6,550,229 | B2 * | 4/2003 | Sperry et al. | 53/568 |
| 6,598,373 | B2 * | 7/2003 | Sperry et al. | 53/403 |
| 6,619,843 | B2 * | 9/2003 | Harmanoglu | 383/38 |
| 2002/0067865 | A1 * | 6/2002 | Stutzman | 383/38 |
| 2004/0013323 | A1 * | 1/2004 | Withers | 383/63 |
| 2005/0078888 | A1 * | 4/2005 | Taheri | 383/107 |

FOREIGN PATENT DOCUMENTS

| | | | |
|---|---|---|---|
| EP | 614829 | A1 * | 9/1994 |
| FR | 2687986 | A1 * | 9/1993 |

* cited by examiner

*Primary Examiner*—Jes F Pascua
(74) *Attorney, Agent, or Firm*—Roland H. Shubert

(57) ABSTRACT

A multi-compartment liner bag is disposed within a receptacle and includes a first compartment having a height that is greater than that of the receptacle and a volume that is at least about equal to that of the receptacle. A second bag compartment is attached to and folds to the side of the first compartment when placed in the receptacle and has an entry folded over the receptacle top to form at least a visual seal to the compartment contents. Indicia means, which may be either visual or tactile, are provided along the second compartment entry to allow easy location of the compartment entry.

13 Claims, 5 Drawing Sheets

MULTI-COMPARTMENT TRASH OR RECYCLING BAG

BACKGROUND OF THE INVENTION

1. Field of the Invention

This invention relates generally to bags that are used as liners for waste baskets, trash cans, and the like.

More specifically, this invention relates to multi-compartment trash or refuse bags that are used in association with, or as liners for, containers used as a repository for soiled, recyclable, or discarded items.

2. Description of Related Art

Waste baskets, trash cans, and similar open-topped containers are commonly used in kitchens, bathrooms, bedrooms, offices, garages and shops as a repository for soiled or discarded personal care, recyclable, and other waste materials. Such containers typically employ a bag-like liner of plastic film or similar material and the liner is usually sized somewhat larger than the container. That allows a filled liner bag to be securely closed so that the bag and its contents can be removed from the container without danger of spillage. Means that have been used to secure the bag in a closed position include plastic or metal ties, a drawstring arranged within a channel disposed at the open bag end, and various adhesive or mechanical sealing strips arranged to close and seal the open bag end.

It is often the case that in bathroom or bedroom use, some of the waste materials needing disposal are soiled, odorous, unsanitary, or of a personal nature while the remainder of the waste material is of a more innocuous kind. Segregation and interim storage of the different waste types now requires separate repositories. Different types of waste materials are also commonly found in kitchen or office use. In kitchen use, for example, it often is desirable to segregate food preparation wastes and scraps from paper, empty containers and cans so that the one type of waste can be composted and the other type of waste recycled. Again, separate containers are required for the segregated collection and interim storage of the different trash types. An analogous situation exists with office trash.

This invention provides a multi-compartment liner for trash and refuse containers that allows separation of different types or classes of discarded items for interim storage and later disposal. It also ensures a more esthetic environment in that one type of discarded item may remain hidden from direct view during a period of interim storage.

Other advantages of this invention will become evident from the following description of the invention and of specific embodiments thereof.

SUMMARY OF THE INVENTION

A multi-compartment bag that is constructed of a flexible plastic film and is adapted for use as a liner for a trash or refuse container includes a first compartment that is open at the top, and at least one additional compartment having an entry that is folded over a side of the container to close the compartment but to allow placement of discarded items through the entry and into the closed compartment where the discarded items remain shielded from view. After use, the compartments may be separated one from another for segregated disposal of the contents.

DESCRIPTION OF PREFERRED EMBODIMENTS OF THE INVENTION

Preferred embodiments of this invention will be described in relation first to FIG. 1 in which the multi-compartment bag liner of this invention is shown at 10 in top plan view as it is used with and disposed in a trash receptacle 11 such as a conventional waste basket or kitchen garbage container. The bag liner follows the contours the trash receptacle, which has a flat bottom 12, two side members 14,15 and a pair of end members 17,18. Those side and end members are shown to taper inwardly from top to bottom as is typical of many receptacles in common use but the liner of this invention works equally well when used with vertical walled receptacles.

Figure 1:
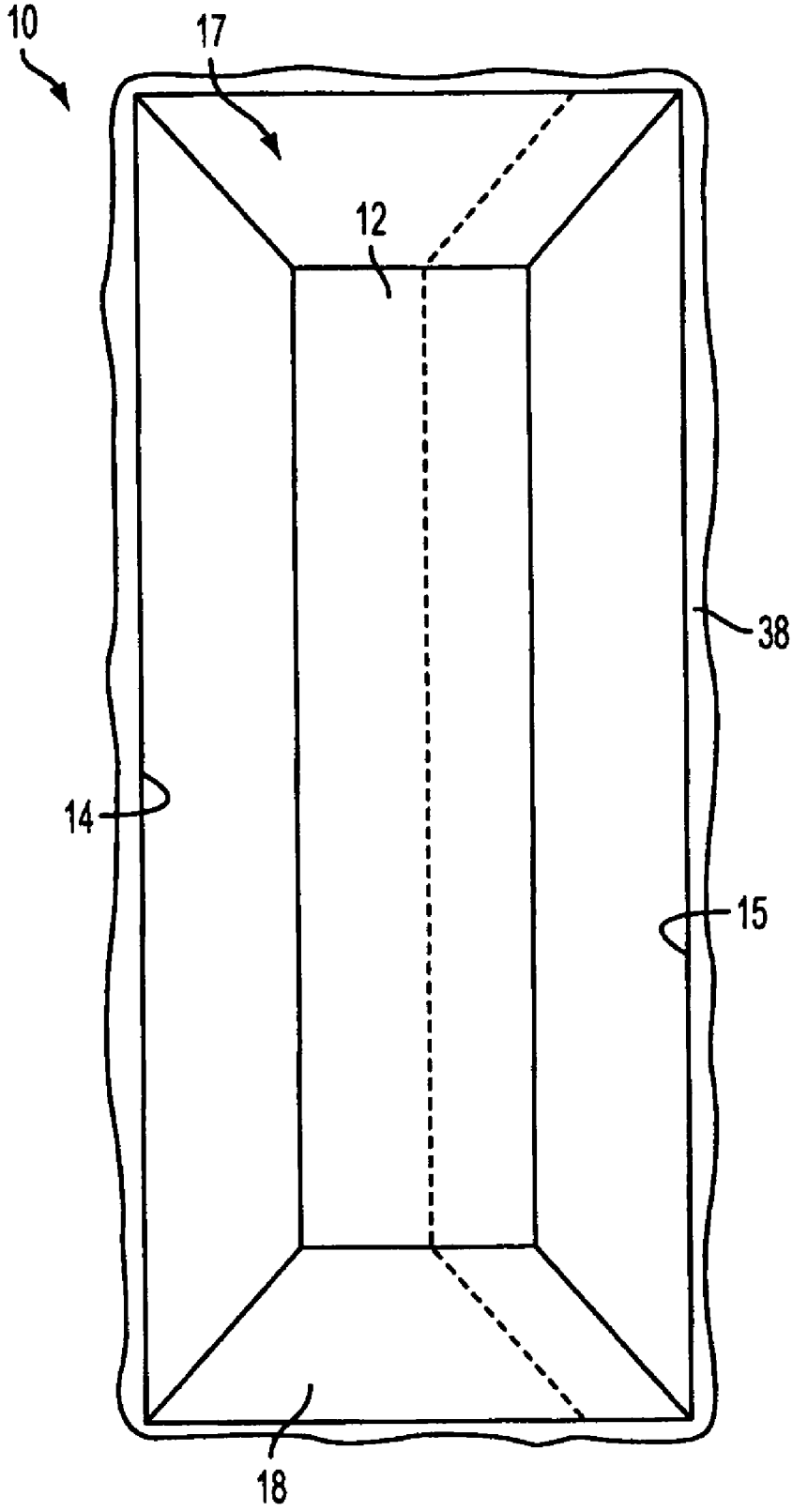
FIG. 1 is a stylized plan view of a trash container having the multi-compartment trash bag of this invention in place therein.
Figure 2:
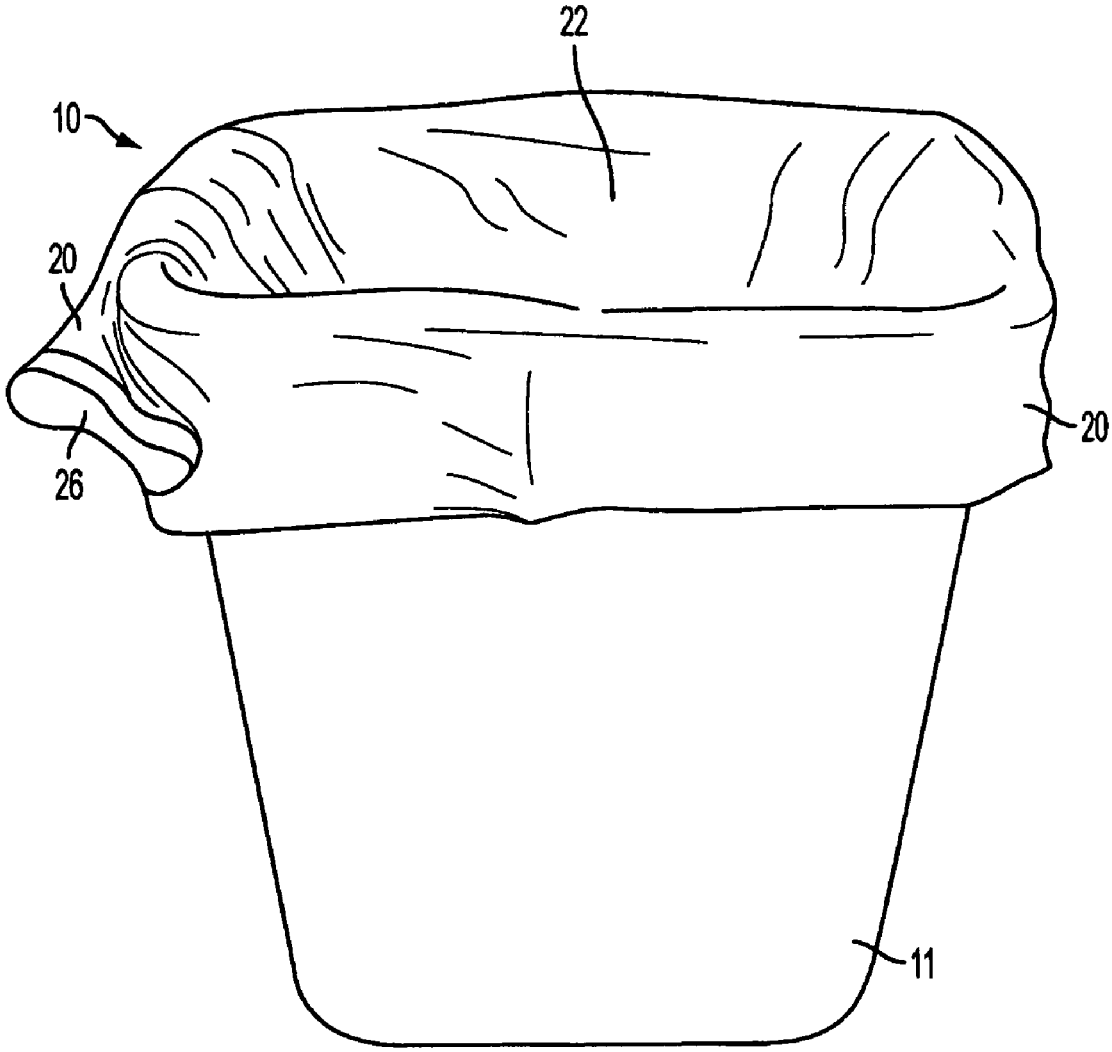
FIG. 2 is a front perspective view of a the bag and trash container of FIG. 1 positioned such that a closed bag compartment opens to the container side.
Figure 3:
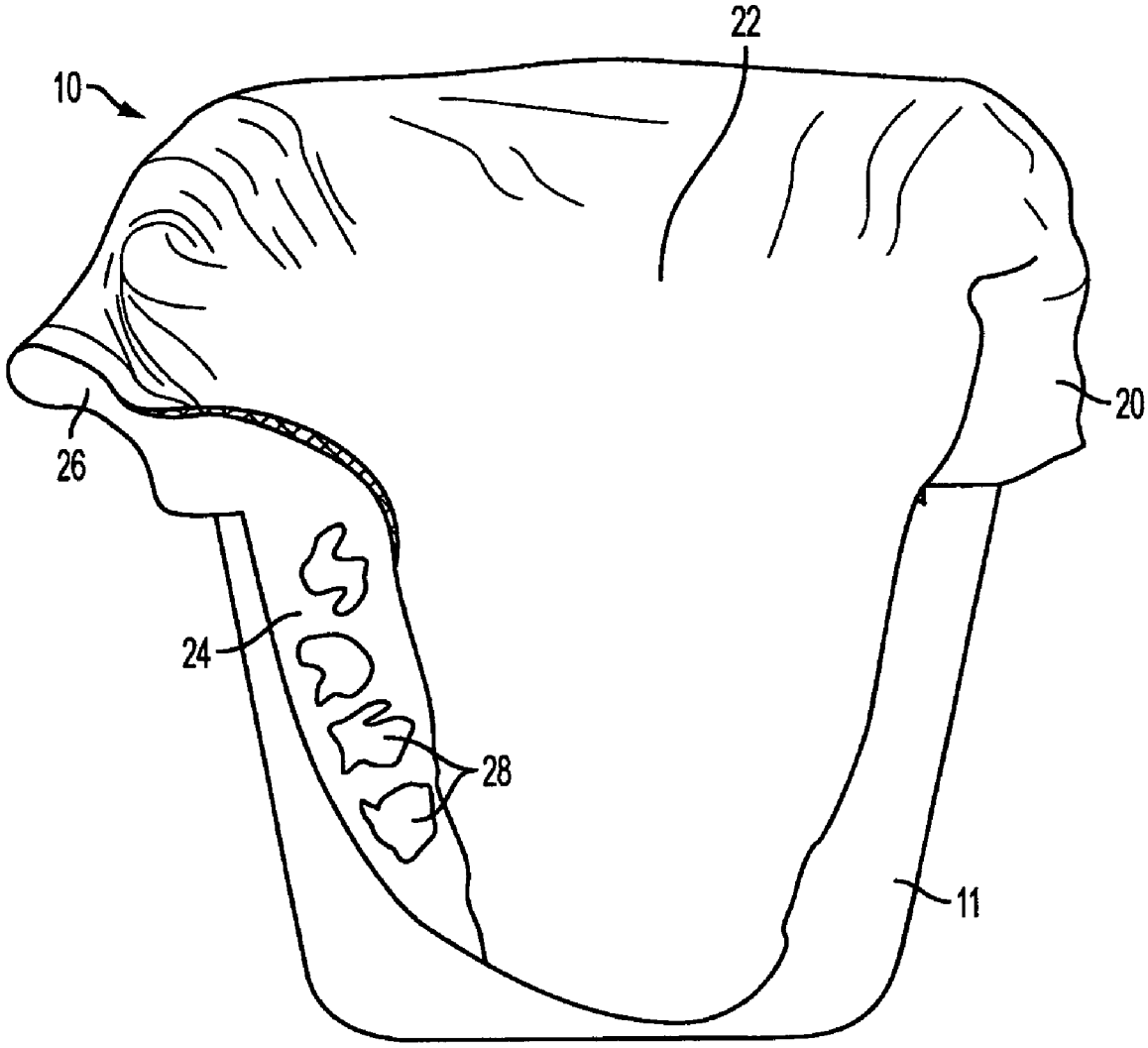
FIG. 3 is a partially cut away front elevational view of the bag and trash container of FIGS. 1 and 2 illustrating the relationship of adjacent compartments.
Figure 4:
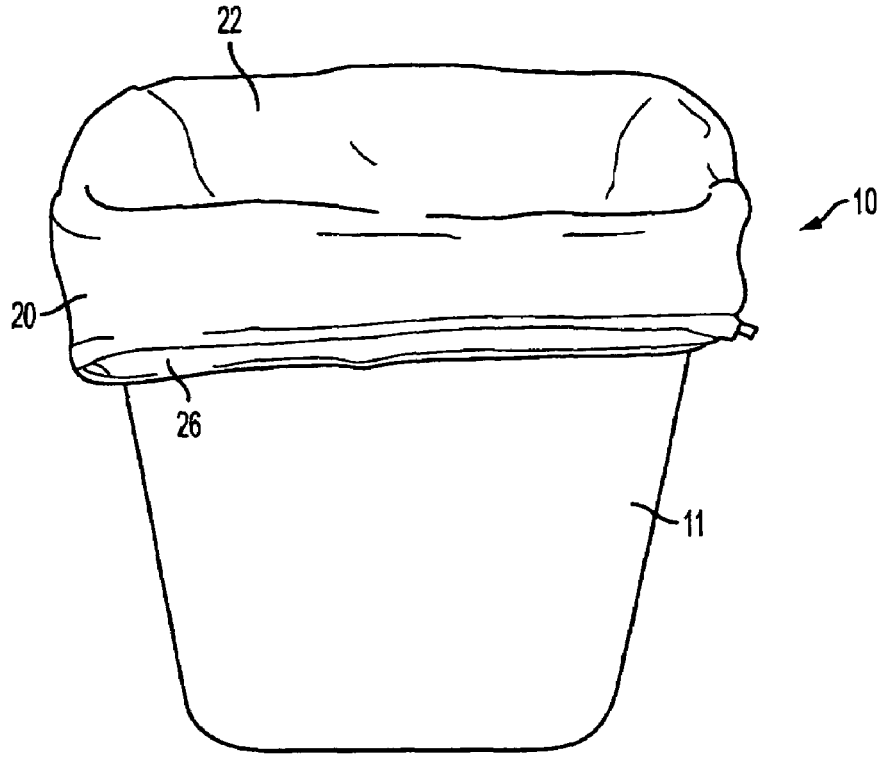
FIG. 4 is a front perspective view of the bag and trash container of FIG. 1 positioned such that a closed bag compartment opens to the container front.

Referring now to FIGS. 2, 3 and 4 as well as FIG. 1, it is necessary that the bag liner have a somewhat greater height (or depth) than the receptacle 11 in which it is placed so that a top portion of the bag forms a fold 20 over the top lip of the receptacle. The bag liner 10, as shown in FIGS. 1-4, includes two compartments. A first open compartment 22 is preferably sized to encompass most or all of the receptacle volume while a second closed, or side, compartment 24 is provided with an entry 26 located at the terminus of fold 20.

For most purposes, compartment 24 will be smaller than compartment 22 but it may also be equal in size to or even larger than compartment 22. Entry 26 may be located at the receptacle end as illustrated in FIG. 2 or may be located at the receptacle side as shown in FIG. 4. As discarded items 28 are inserted through entry 26 into compartment 24, it expands into a part, or even all, of the space occupied by open compartment 22. By locating entry 26 at the fold terminus, items placed into compartment 24 are shielded from view. The fold 20 also serves as a seal to significantly reduce or even eliminate odors from discarded personal care items and the like that are placed into the closed compartment 24.

Figure 5:
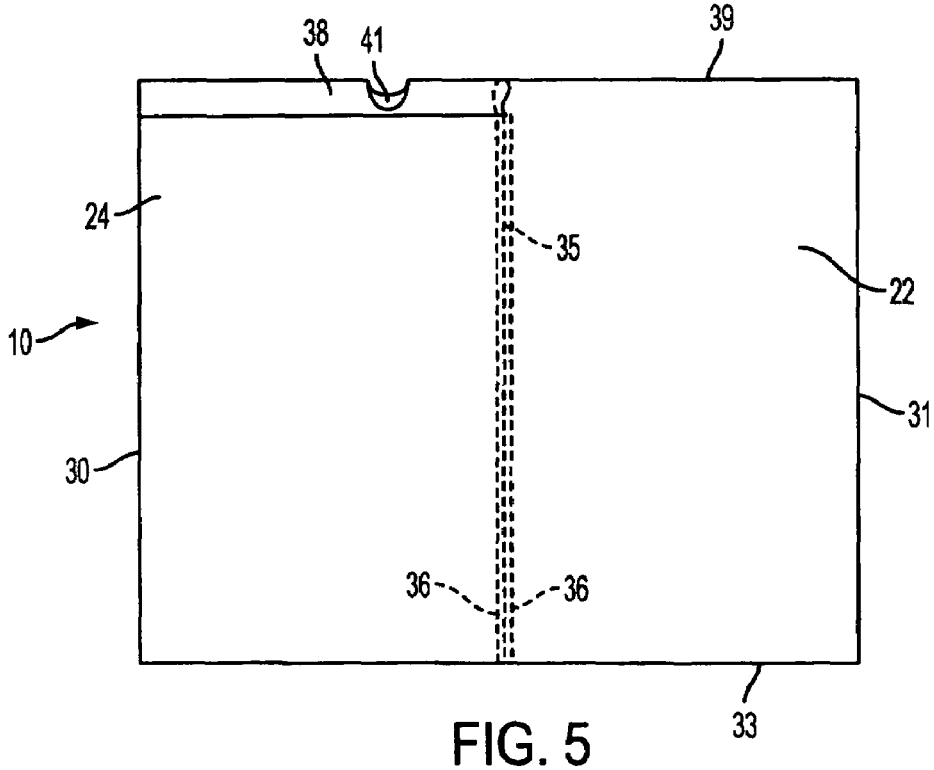
FIG. 5 is an elevational view of the bag liner of FIG. 1 illustrating details of its construction.
Figure 6:
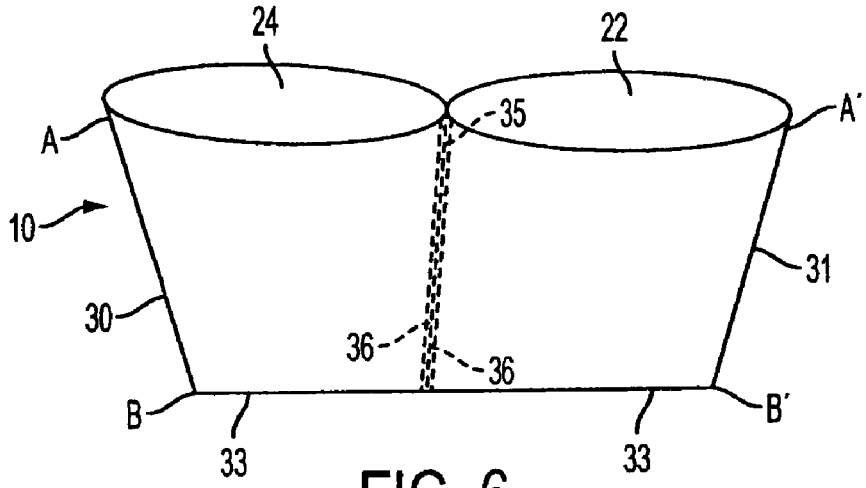
FIG. 6 is a perspective view of the bag liner of FIG. 5 shown in a partially open position.
Figure 7:
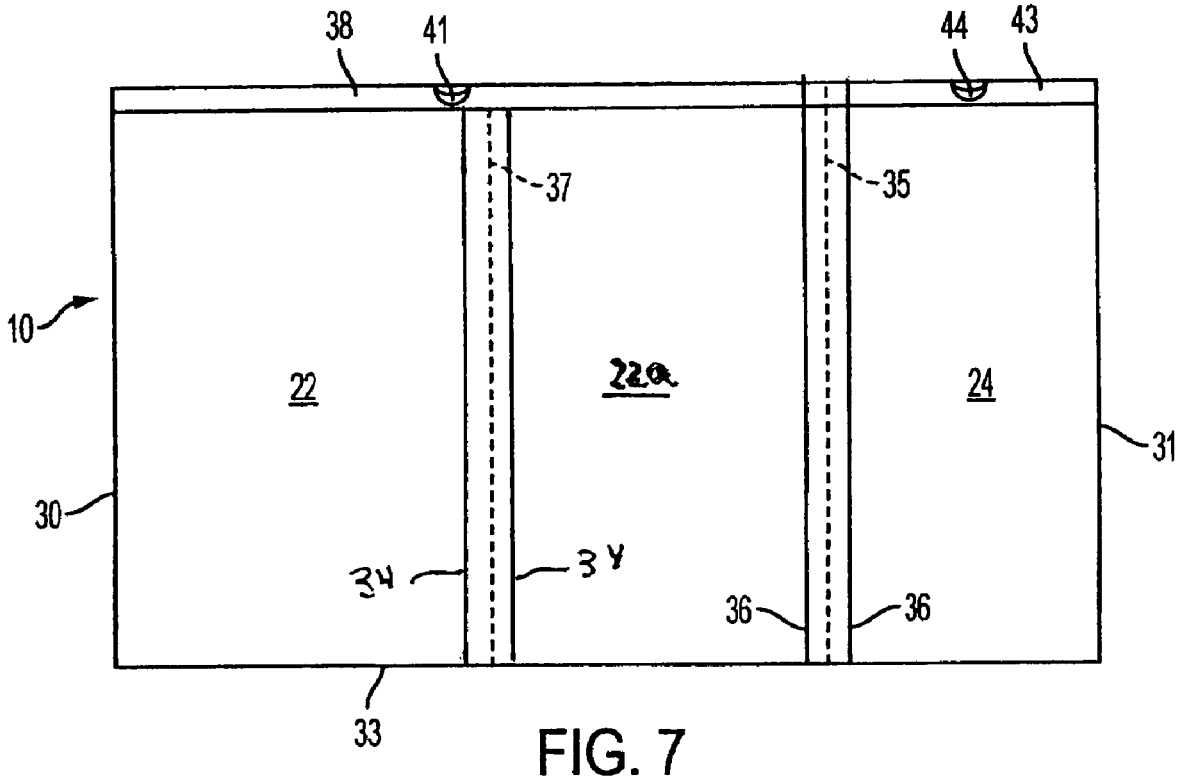
FIG. 7 is an elevational view of another embodiment of the bag liner of FIG. 5 that is adapted specifically for kitchen use.

FIGS. 5, 6 and 7 illustrate details of the bag construction. In an embodiment of the invention that is illustrated in FIG. 5, a two-compartment, rectangular bag is formed by sealing together two layers of a plastic film, suitably polyethylene, at the two sides, 30 and 31, and along the bottom 33, leaving the top open. Detachment means comprising a seam or tear strip 35, having a sealed seam 36 immediately adjacent each side, is placed intermediate sides 30 and 31 and parallel to them so as to define two compartments, an open compartment 22 and a side or closed compartment 24. Seam 35 is preferably formed as a tear strip so that the two compartments, 22 and 24, can be separated one from the other while maintaining a sealed edge 36 to each compartment.

FIG. 6 presents a downwardly looking, perspective view of the two-compartment bag of FIG. 5. Referring specifically to FIG. 6, bag 10 is sized relative to the container with which it is used such that the volume of compartment 22 is substantially equal to or greater than is the volume of the container, and that the height of side 30 is greater than is the depth of the container. Bag 10 is prepared for placement as a liner within the container by folding it along seam 35 so that point A is adjacent point A' and point B is adjacent point B'. The folded bag is then placed into the container and compartment 22 is opened up so as to be accessible from the container top, and the top bag margin is folded over the edges of the container top in the manner illustrated in FIGS. 1-4. That arrangement leaves the entry 26 of the closed container 24 draped over a side of the container.

It is preferred that the top margin strip 38 of compartment 24 be visually and/or tactilely different from the top margin 39 of compartment 22 so that entry 26 can be easily located for the convenient insertion of items being discarded. Differentiation between the tops of the two compartments may be achieved by forming margin strip 38 as a closure means, such as a drawstring 41 disposed within a channel formed by margin strip 38, an adhesive strip, or a tie, or by adding a surface texture that is markedly different from the texture of the remaining bag surface, or by adding a distinctive coloration to strip 38, or both. Similar or different closure means may also be used to seal the top 39 of compartment 22. As items are discarded into compartment 24 it expands into the space within the container originally occupied by compartment 22 but keeps the contents of the compartment hidden from view. When the contents of either or both of the compartments fill the container, the bag may be removed from the container for disposal. At that time, the two compartments may be separated one from the other by parting the compartments along seam 35 and the compartments may then be disposed of separately if so desired.

FIG. 7 depicts another embodiment of the invention that is particularly adapted for use in a kitchen or work place environment. This embodiment comprises a rectangular, multi-compartment bag 10 that is sized for use with a standard trash container. As with the embodiment shown in FIG. 5, it may conveniently be formed from two sheets of plastic film that are bonded, as by heat sealing or other appropriate technique, along generally parallel sides 30, 31 and 36, and along the bag bottom 33 so as to form two open-topped compartments 22 and 24. A tear line 35 may be placed between the adjacent sides 36 So that the compartments may be separated one from the other. It is preferred that each of the compartments be provided with closure means to secure the compartment top in a closed position when filled. The closure means for compartment 22 may comprise a draw string 41 disposed within a channel formed by margin strip 38, or may comprise other closure means including adhesive strips, ties, and the like. Likewise, compartment 24 is provided with top closure means illustrated in the Figure as a draw string 44 disposed within a channel 43. The FIG. 7 embodiment is particularly useful for segregating recyclable items such as cans and bottles from ordinary trash or for segregating material that is suitable for composting from paper waste and the like. Although two-compartment bags have been illustrated in the Figures, it is equally feasible to provide three compartments within a single bag by adding a second seam or tear line 37, with bonded sides 34 similar to seam or tear line 35 and bonded sides 36, at any desired location between side 30 and tear line 35 so as to divide compartment 22 into two parts, thereby allowing additional classification and separation of discarded or recyclable items.

As may be appreciated from the foregoing description, this invention provides an esthetically practical means for disposing of used personal care items and the like, and various modifications are possible in the practice of this invention without departing from the spirit and scope of the following claims.

I claim:

1. A multi-compartment liner bag and a receptacle suitable for the segregated interim storage and disposal of discarded or recyclable items comprising:

a generally rectangular bag having a closed bottom and open top disposed within the receptacle, the bag having at least two compartments that are detachable one from the other, the first of said compartments having a height greater than that of the refuse receptacle in which it is disposed and a volume that is at least about equal to that of said receptacle, a second of said compartments having a height that is at least equal to that of the first compartment, the top of said second compartment forming an entry that is folded over a top edge of said receptacle to thereby seal any contents of said second compartment from view, and indicia at the top of said second compartment arranged to allow a user to recognize said entry.

2. The liner bag of claim 1 wherein said indicia comprise a margin strip along the top edge of said second compartment.

3. The liner bag of claim 2 wherein the surface texture of said margin strip is tactilely different from that of the remaining bag structure.

4. The liner bag of claim 2 wherein the color of said margin strip is different from that of the remaining bag structure.

5. The liner bag of claim 2 wherein said margin strip includes a closure means.

6. The liner bag of claim 5 wherein said closure means comprises a drawstring disposed within a channel.

7. The liner bag of claim 5 wherein said closure means comprises an adhesive strip.

8. The liner bag of claim 1 wherein said second compartment is smaller in volume than is said first compartment.

9. The liner bag of claim 1 including detachment means to allow separation of one compartment from another, said detachment means comprising a seam intermediate the bag sides and generally parallel to them.

10. The liner bag of claim 9 wherein said seam comprises a tear strip having a sealed seam immediately adjacent each strip side.

11. The liner bag of claim 1 wherein said first compartment includes closure means adapted to seal said compartment top after it is detached from the second compartment.

12. The liner bag of claim 11 wherein said closure means comprises a drawstring arranged within a channel.

13. The liner bag of claim 1 including three compartments, each compartment detachable from adjacent compartments.

* * * * *